US007445427B2

(12) United States Patent
Gutknecht et al.

(10) Patent No.: US 7,445,427 B2
(45) Date of Patent: Nov. 4, 2008

(54) VARIABLE STATOR VANE ASSEMBLY AND BUSHING THEREOF

(75) Inventors: James Edward Gutknecht, Cincinnati, OH (US); Robert William Bruce, Loveland, OH (US); Jay L. Cornell, Hamilton, OH (US); Donald Charles Slavik, Milford, OH (US); Wayne Ray Bowen, West Chester, OH (US); William Terence Dingwell, Lebanon, OH (US)

(73) Assignee: General Electric Company, Schnectady, NY (US)

( * ) Notice: Subject to any disclaimer, the term of this patent is extended or adjusted under 35 U.S.C. 154(b) by 129 days.

(21) Appl. No.: 11/294,150

(22) Filed: Dec. 5, 2005

(65) Prior Publication Data

US 2007/0128017 A1 Jun. 7, 2007

(51) Int. Cl.
*F01D 17/16* (2006.01)

(52) U.S. Cl. ..... 415/160

(58) Field of Classification Search ..... 415/160, 415/162, 191, 193, 159, 200
See application file for complete search history.

(56) References Cited

U.S. PATENT DOCUMENTS

| | | | |
|---|---|---|---|
| 3,947,147 | A | 3/1976 | Loktaeva et al. |
| 6,139,261 | A | 10/2000 | Bishop et al. |
| 6,264,369 | B1 | 7/2001 | Mesing et al. |
| 6,767,183 | B2 | 7/2004 | Schilling et al. |
| 6,808,364 | B2 | 10/2004 | O'Reilly et al. |
| 2001/0016091 | A1 | 8/2001 | Mesing et al. |
| 2004/0240991 | A1 | 12/2004 | Bruce |

FOREIGN PATENT DOCUMENTS

| | | |
|---|---|---|
| EP | 1 482 129 | 12/2004 |

*Primary Examiner*—Edward Look
*Assistant Examiner*—Dwayne J White
(74) *Attorney, Agent, or Firm*—Jonathan M. Hines; William Scott Andes

(57) ABSTRACT

A variable stator vane assembly and a bushing thereof. The bushing includes a metal bushing body and a wear-resistant coating. The assembly includes a rotatable trunnion and a first metal bushing. The trunnion is capable of being located in a through hole extending between outer and inner surfaces of a compressor casing of a gas turbine engine. The first metal bushing is capable of being located in the through hole proximate the outer surface to surround a first portion of the trunnion when the trunnion is located in the through hole. The first metal bushing and the first portion have wear-resistant coatings which are in mutual contact, apart from any intervening lubricant, when the trunnion and the first metal bushing are located in the through hole and the trunnion is rotating with respect to the first metal bushing.

20 Claims, 3 Drawing Sheets

VARIABLE STATOR VANE ASSEMBLY AND BUSHING THEREOF

BACKGROUND OF THE INVENTION

The present invention relates generally to gas turbine engines, and more particularly to a variable stator vane assembly of a gas turbine engine and to a bushing of such an assembly.

Variable stator vane assemblies have been used in aircraft gas-turbine-engine compressors since 1950. Such compressors contain alternating rows of stator vanes and rotating blades. The vane airfoils of a row of variable stator vanes are turned about their longitudinal axes to a different position for different incoming airflows to straighten the airflow which will encounter the adjacent downstream row of rotating compressor blades. A trunnion is used to turn a vane airfoil, wherein the trunnion is supported by polymeric or graphite bushings installed in a through hole of the compressor casing. The bushings are replaced, as needed, due to wear of the bushings from the trunnion being turned with respect to the bushings.

Still, scientists and engineers continue to seek improved variable stator vane assemblies and improved bushings of variable stator vane assemblies.

BRIEF DESCRIPTION OF THE INVENTION

A first expression of an embodiment of the invention is a variable stator vane assembly including a rotatable variable-stator-vane trunnion and a first metal bushing. The trunnion is capable of being located in a through hole extending between outer and inner surfaces of a compressor casing of a gas turbine engine. The first metal bushing is capable of being located in the through hole proximate the outer surface to surround a first portion of the trunnion when the trunnion is located in the through hole. The first metal bushing and the first portion have wear-resistant coatings which are in mutual contact, apart from any intervening lubricant, when the trunnion and the first metal bushing are located in the through hole and the trunnion is rotating with respect to the first metal bushing.

A second expression of an embodiment of the invention is a variable-stator-vane-assembly bushing including a metal bushing body which is capable of being located in a through hole extending between outer and inner surfaces of a compressor casing of a gas turbine engine to surround a wear-resistant coating of a portion of a rotatable variable-stator-vane trunnion which is located in the through hole. The metal bushing body has a wear-resistant coating which is in contact, apart from any intervening lubricant, with the wear-resistant coating of the portion of the trunnion when the metal bushing body is located in the through hole and the trunnion is rotating with respect to the metal bushing body.

A third expression of an embodiment of the invention is a variable stator vane assembly including a rotatable variable-stator-vane trunnion, a first metal bushing, a second metal bushing, and a gas seal. The trunnion is located in a through hole extending between outer and inner surfaces of a compressor casing of a gas turbine engine. The first metal bushing is located in the through hole proximate the outer surface and surrounds a first portion of the trunnion. The first metal bushing and the first portion have wear-resistant coatings which are in mutual contact, apart from any intervening lubricant, when the trunnion is rotating with respect to the first metal bushing. The second metal bushing is located in the through hole proximate the inner surface and surrounds a second portion of the trunnion. The second metal bushing and the second portion have wear-resistant coatings which are in mutual contact, apart from any intervening lubricant, when the trunnion is rotating with respect to the second metal bushing. The gas seal is located in the through hole and surrounds a third portion of the trunnion, wherein the third portion is located between the first and second portions. The gas seal is more flexible (at the same temperature) than either of the first and second metal bushings.

In one example of the first, second, and/or third expressions of the embodiment of the invention, the wear-resistant coatings consist essentially of tungsten carbide which provides excellent wear resistance for operating temperatures of substantially 400 degrees Fahrenheit to substantially 1000 degrees Fahrenheit, such temperature range being expected to be encountered by variable stator vane assemblies for state-of-the-art gas turbine engine designs and such temperature range extending beyond the operating temperature limit of conventional polymeric or graphite bushings.

BRIEF DESCRIPTION OF THE DRAWING

The accompanying drawing illustrates an embodiment of the invention wherein.

DETAILED DESCRIPTION OF THE INVENTION

Figure 1:
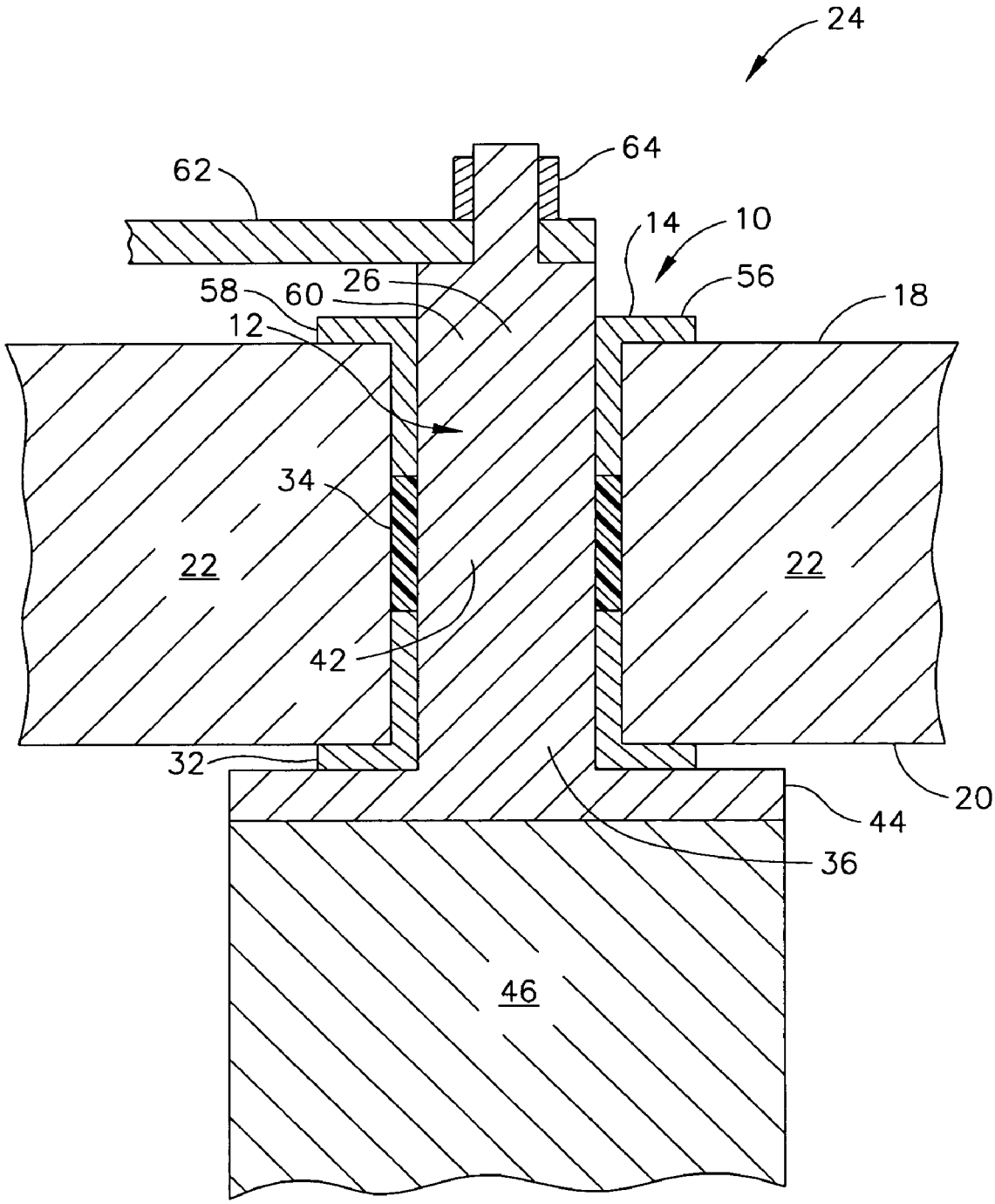
FIG. 1 is a schematic cross-sectional view of an embodiment of a variable stator vane assembly of a gas turbine engine wherein such assembly includes two bushings.
Figure 2:
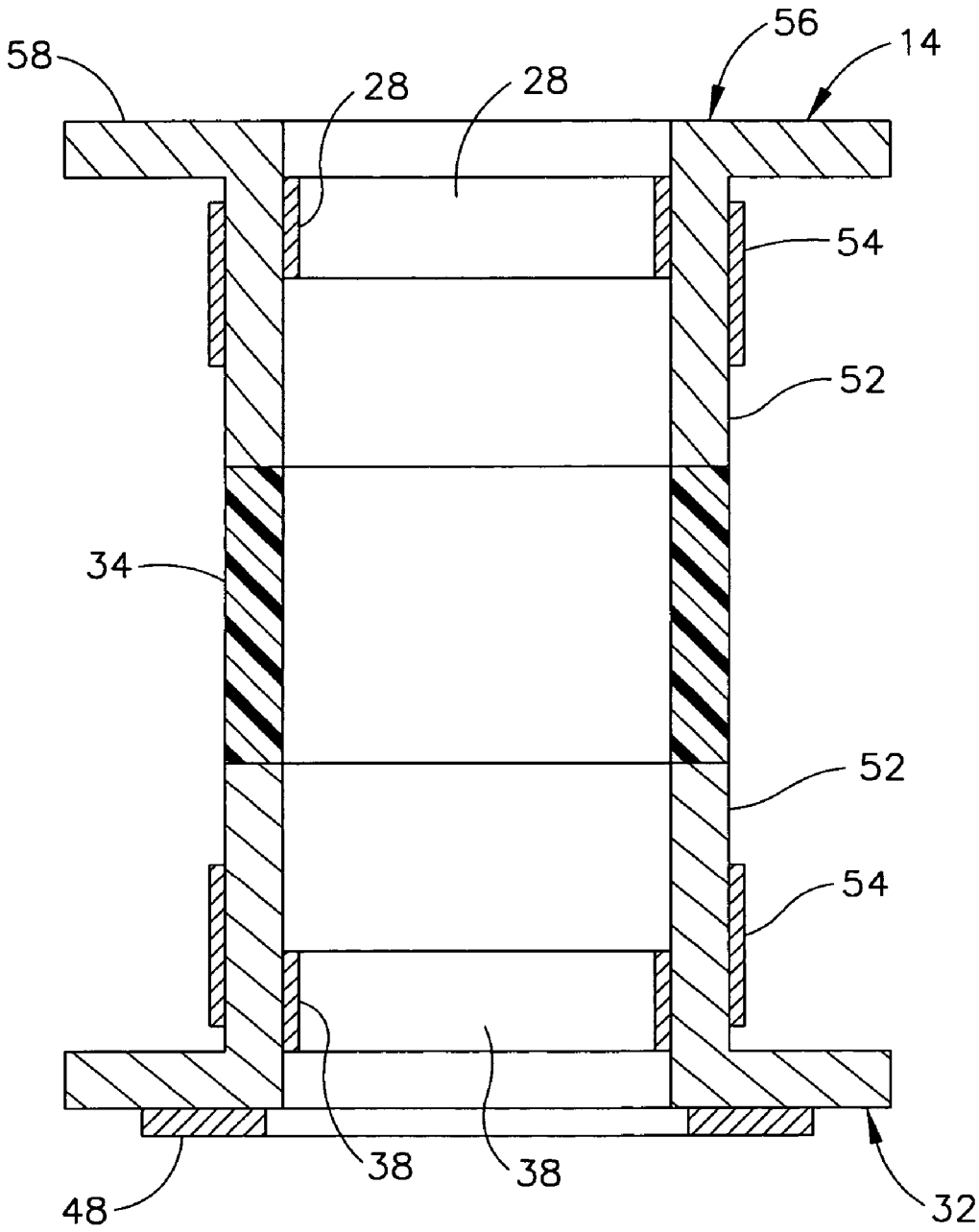
FIG. 2 is a cross-sectional view of the two bushings and the gas seal of the assembly of FIG. 1 with coatings enlarged for visibility.
Figure 3:
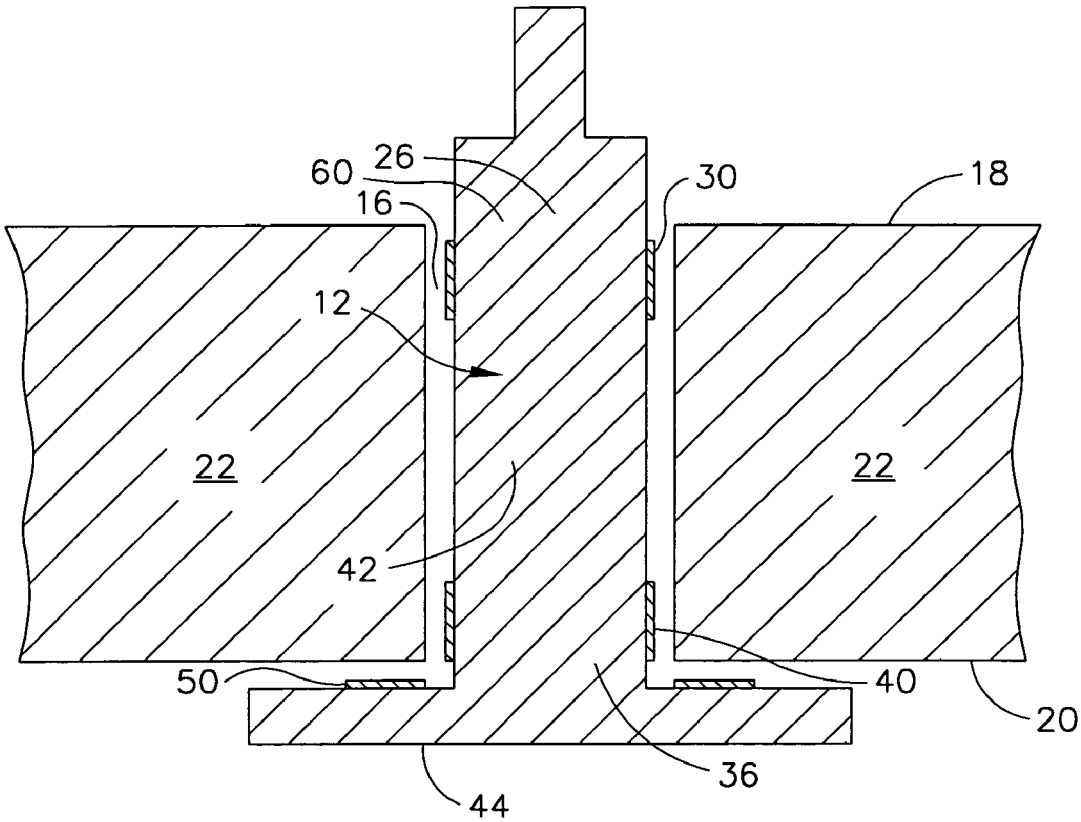
FIG. 3 is across-sectional view of the rotatable variable-stator-vane trunnion, the vane button, and the compressor casing of FIG. 1 with coatings enlarged for visibility.

Referring now to the drawing, FIGS. 1-3 disclose an embodiment of the invention. A first expression of the embodiment of FIGS. 1-3 is for a variable stator vane assembly 10 including a rotatable variable-stator-vane trunnion 12 and a first metal bushing 14. The trunnion 12 is disposable in a through hole 16 extending between outer and inner surfaces 18 and 20 of a compressor casing 22 of a gas turbine engine 24 (only an above-centerline portion of a compressor of the engine being shown). The first metal bushing 14 is disposable in the through hole 16 proximate the outer surface 18 to surround a first portion 26 of the trunnion 12 when the trunnion 12 is disposed in the through hole 16. The first metal bushing 14 and the first portion 26 have wear-resistant coatings which are in mutual contact, apart from any intervening lubricant, when the trunnion 12 and the first metal bushing 14 are disposed in the through hole 16 and the trunnion 12 is rotating with respect to the first metal bushing 14.

It is noted that a wear-resistant coating (or layer or coating material) of a metal bushing is a coating (or layer or coating material), wherein the coating (or layer or coating material) is more resistant to wear from a relatively moving surface having contact with the coating (or layer or coating material), and wherein the first metal bushing is less resistant to wear from the same relatively moving surface having the same contact with the first metal bushing. In one example, the wear-resistant coating (or layer or coating material) is substantially 125 microns thick. It is also noted that describing a metal bushing as being disposed proximate the inner surface of the compressor casing includes the metal bushing being disposed at and/or near the inner surface of the compressor casing, wherein "near the inner surface" means closer to the inner surface than to the outer surface. It is additionally noted that "apart from any intervening lubricant" is not to be construed as requiring an intervening lubricant. It is further noted that describing two components as being in mutual contact when rotation is occurring does not prevent such components from being in mutual contact when rotation is not occurring.

In one enablement of the first expression of the embodiment of FIGS. 1-3, the variable stator vane assembly 10 also includes a second metal bushing 32 and a gas seal 34. The second metal bushing 32 is disposable in the through hole 16 proximate the inner surface 20 to surround a second portion 36 of the trunnion 12 when the trunnion 12 is disposed in the through hole 16. The second metal bushing 32 and the second portion 36 have wear-resistant coatings 38 and 40 which are in mutual contact, apart from any intervening lubricant, when the trunnion 12 and the second metal bushing 32 are disposed in the through hole 16 and the trunnion 12 is rotating with respect to the second metal bushing 32. The gas seal 34 is disposable in the through hole 16 to surround a third portion 42 of the trunnion 12 when the trunnion 12 is disposed in the through hole 16, wherein the third portion 42 is disposed between the first and second portions 26 and 36. The gas seal 34 is more flexible than either of the first and second metal bushings 14 and 32.

In one arrangement of the first expression of the embodiment of FIGS. 1-3, the gas seal 34 is installed with a loose fit (i.e., not a press fit) in the through hole 16. In one variation, the gas seal 34 thermally swells up and seats against the compressor casing 22 during operation of the gas turbine engine 24. In one modification, the gas seal reduces, or even prevents, air leakage through the through hole 16. Such air leakage reduces the efficiency of the gas turbine engine 24 as is known to those skilled in the art. The choice of materials for the gas seal 34 is left to the artisan.

In one application of the first expression of the embodiment of FIGS. 1-3, at least one of the wear-resistant coatings 28 and 30 of the first metal bushing 14 and the first portion 26 is lubricated to reduce friction from rotation of the trunnion 12 with respect to the first metal bushing 14 when the trunnion 12 and the first metal bushing 14 are disposed in the through hole 16. In one variation, at least one of the wear-resistant coatings 38 and 40 of the second metal bushing 32 and the second portion 36 is lubricated to reduce friction from rotation of the trunnion 12 with respect to the second metal bushing 32 when the trunnion 12 and the second metal bushing 32 are disposed in the through hole 16. In one deployment, the first metal bushing 14 and the second metal bushing 32 do not rotate with respect to the compressor casing 22 (and hence bushing-to-casing rotational wear is prevented) because of such lubrication. In one example, such lubrication is provided by a lubricant bonded to, and/or un-bonded on, the wear-resistant coatings.

In one choice of materials of the first expression of the embodiment of FIGS. 1-3, the wear-resistant coatings 28, 38, 30 and 40 of the first and second metal bushings 14 and 32 and the first and second portions 26 and 36 consist essentially of a ceramic. In one variation, the wear-resistant coatings 28, 38, 30 and 40 of the first and second metal bushings 14 and 32 and the first and second portions 26 and 36 are lubricated with a material chosen from the group consisting of graphite, molybdenum di-sulfide, tungsten di-sulfide, boron nitride, bismuth telluride, teflon, and titanium oxide. In one modification, the ceramic consists essentially of tungsten carbide, the first and second metal bushings 14 and 32 and the trunnion 12 consist essentially of steel or titanium, and the gas seal 34 is a polymeric gas seal.

In one implementation of the first expression of the embodiment of FIGS. 1-3, the variable stator vane assembly 10 also includes a vane button 44 which is attached to the trunnion 12 and adapted to support a vane airfoil 46, which is disposed proximate the second portion 36, and which extends substantially perpendicularly away from the trunnion 12. The second metal bushing 32 and the vane button 44 have wear-resistant layers 48 and 50 which are in mutual contact, apart from any intervening lubricant, when the trunnion 12 and the second metal bushing 32 are disposed in the through hole 16 and the trunnion 12 is rotating with respect to the second metal bushing 32. It is noted that "attached" includes monolithically attached and non-monolithically attached.

In one employment of the first expression of the embodiment of FIGS. 1-3, the first and second metal bushings 14 and 32 each include an outer circumferential surface 52 which is coated with a wear-resistant material 54 which contacts the compressor casing 22 when the first and second metal bushings 14 and 32 are disposed in the through hole 16 allowing for removal and reinstallation of the same bushing during maintenance inspections while reducing wear on the outer circumferential surface of the bushing. In the same or a different employment, the first and second metal bushings 14 and 32 are adapted to be press fitted into the through hole 16 further ensuring that the bushings do not rotate relative to the compressor casing. In the same or a different employment, the first and second metal bushings 14 and 32 and the compressor casing 22 have substantially equal coefficients of thermal expansion further ensuring that the bushings do not rotate relative to the compressor casing throughout the operational temperature range of the variable stator vane assembly.

A second expression of the embodiment of FIGS. 1-3 is for a variable-stator-vane-assembly bushing 56 including a metal bushing body 58. The metal bushing body 58 is disposable in a through hole 16 extending between outer and inner surfaces 18 and 20 of a compressor casing 22 of a gas turbine engine 24 to surround a wear-resistant coating 30 of a portion 60 of a rotatable variable-stator-vane trunnion 12 which is disposed in the through hole 16. The metal bushing body 58 has a wear-resistant coating 28 which is in contact, apart from any intervening lubricant, with the wear-resistant coating 30 of the portion 60 of the trunnion 12 when the metal bushing body 58 is disposed in the through hole 16 and the trunnion 12 is rotating with respect to the metal bushing body 58.

In one arrangement of the second expression of the embodiment of FIGS. 1-3, the wear resistant coating 28 of the metal bushing body 58 is lubricated to reduce friction from rotation of the trunnion 12 with respect to the metal bushing body 58 when the metal bushing body 58 is disposed in the through hole 16. In one choice of materials, the wear-resistant coating 28 of the metal bushing body 58 consists essentially of a ceramic. In one illustration, the metal bushing body 58 is adapted to be press fitted into the through hole 16.

A third expression of the embodiment of FIGS. 1-3 is for a variable stator vane assembly 10 including a rotatable variable-stator-vane trunnion 12, a first metal bushing 14, a second metal bushing 32, and a gas seal 34. The trunnion 12 is disposed in a through hole 16 extending between outer and inner surfaces 18 and 20 of a compressor casing 22 of a gas turbine engine 24. The first metal bushing 14 is disposed in the through hole 16 proximate the outer surface 18 and surrounds a first portion 26 of the trunnion 12. The first metal bushing 14 and the first portion 26 have wear-resistant coatings 28 and 30 which are in mutual contact, apart from any intervening lubricant, when the trunnion 12 is rotating with respect to the first metal bushing 14. The second metal bushing 32 is located in the through hole 16 proximate the inner surface 20 and surrounds a second portion 36 of the trunnion 12. The second metal bushing 32 and the second portion 36 have wear-resistant coatings 38 and 40 which are in mutual contact, apart from any intervening lubricant, when the trunnion 12 is rotating with respect to the second metal bushing 32. The gas seal 34 is disposed in the through hole 16 and surrounds a third portion 42 of the trunnion 12, wherein the third portion 42 is located between the first and second portions 26 and 36. The gas seal 34 is more flexible than either of the first and second metal bushings 14 and 32.

In one example of the first, second and/or third expression of the embodiment of FIGS. 1-3, the compressor casing 22 is a casing of a high pressure compressor and the gas turbine engine 24 is an aircraft gas turbine engine. In one configuration, the variable stator vane assembly 10 includes a lever arm 62 which is moved by an actuator (not shown) as commanded by a controller (not shown) and which turns the trunnion 12. In one variation, a nut 64 secures the lever arm 62 to the trunnion 12.

It is noted that the applications, choices of materials, implementations, etc. of the first expression of the embodiment of FIGS. 1-3 are equally applicable to the third expression of the embodiment of FIGS. 1-3.

While the present invention has been illustrated by a description of several expressions of an embodiment, it is not the intention of the applicants to restrict or limit the spirit and scope of the appended claims to such detail. Numerous other variations, changes, and substitutions will occur to those skilled in the art without departing from the scope of the invention.

The invention claimed is:

1. A variable stator vane assembly comprising:

a) a rotatable variable-stator-vane trunnion consisting essentially of steel or titanium which is disposable in a through hole extending between outer and inner surfaces of a compressor casing of a gas turbine engine; and b) a first metal bushing consisting essentially of steel or titanium which is disposable in the through hole proximate the outer surface to surround a first portion of the trunnion when the trunnion is disposed in the through hole, wherein the first metal bushing and the first portion have wear-resistant coatings consisting essentially of a ceramic disposed thereon which are in mutual contact, apart from any intervening lubricant, when the trunnion and the first metal bushing are disposed in the through hole and the trunnion is rotating with respect to the first metal bushing.

2. The variable stator vane assembly of claim 1, also including:

c) a second metal bushing which is disposable in the through hole proximate the inner surface to surround a second portion of the trunnion when the trunnion is disposed in the through hole, wherein the second metal bushing and the second portion have wear-resistant coatings which are in mutual contact, apart from any intervening lubricant, when the trunnion and the second metal bushing are disposed in the through hole and the trunnion is rotating with respect to the second metal bushing; and d) a gas seal which is disposable in the through hole to surround a third portion of the trunnion when the trunnion is disposed in the through hole, wherein the third portion is disposed between the first and second portions, and wherein the gas seal is more flexible than either of the first and second metal bushings.

3. The variable stator vane assembly of claim 2, wherein at least one of the wear-resistant coatings of the first metal bushing and the first portion is lubricated to reduce friction from rotation of the trunnion with respect to the first metal bushing when the trunnion and the first metal bushing are disposed in the through hole, and wherein at least one of the wear-resistant coatings of the second metal bushing and the second portion is lubricated to reduce friction from rotation of the trunnion with respect to the second metal bushing when the trunnion and the second metal bushing are disposed in the through hole.

4. The variable stator vane assembly of claim 3, wherein the wear-resistant coatings of the first and second metal bushings and the first and second portions consist essentially of a ceramic.

5. The variable stator vane assembly of claim 4, wherein the wear-resistant coatings of the first and second metal bushings and the first and second portions are lubricated with graphite.

6. The variable stator vane assembly of claim 4, wherein the ceramic consists essentially of tungsten carbide, and wherein the gas seal is a polymeric gas seal.

7. The variable stator vane assembly of claim 2, also including a vane button which is attached to the trunnion and adapted to support a vane airfoil, which is disposed proximate the second portion, and which extends substantially perpendicularly away from the trunnion, wherein the second metal bushing and the vane button have wear-resistant layers which are in mutual contact, apart from any intervening lubricant, when the trunnion and the second metal bushing are disposed in the through hole and the trunnion is rotating with respect to the second metal bushing.

8. The variable stator vane assembly of claim 7, wherein the first and second metal bushings each include an outer circumferential surface which is coated with a wear-resistant material which contacts the compressor casing when the first and second metal bushings are disposed in the through hole.

9. The variable stator vane assembly of claim 2, wherein the first and second metal bushings are adapted to be press fitted into the through hole.

10. The variable stator vane assembly of claim 9, wherein the first and second metal bushings and the compressor casing have substantially equal coefficients of thermal expansion.

11. A variable-stator-vane-assembly bushing comprising a metal bushing body consisting essentially of steel or titanium which is disposable in a through hole extending between outer and inner surfaces of a compressor casing of a gas turbine engine to surround a wear-resistant coating consisting essentially of a ceramic disposed on a portion of a rotatable variable-stator-vane trunnion consisting essentially of steel or titanium which is disposed in the through hole, wherein the metal bushing body has a wear-resistant coating consisting essentially of a ceramic disposed thereon which is in contact, apart from any intervening lubricant, with the wear-resistant coating of the portion of the trunnion when the metal bushing body is disposed in the through hole and the trunnion is rotating with respect to the metal bushing body.

12. The variable-stator-vane-assembly bushing of claim 11, wherein the wear resistant coating of the metal bushing body is lubricated to reduce friction from rotation of the trunnion with respect to the metal bushing body when the metal bushing body is disposed in the through hole.

13. The variable-stator-vane-assembly bushing of claim 12, wherein the wear-resistant coating of the metal bushing body consists essentially of a ceramic.

14. The variable-stator-vane-assembly bushing of claim 13, wherein the metal bushing body is adapted to be press fitted into the through hole.

15. A variable stator vane assembly comprising:

a) a rotatable variable-stator-vane trunnion consisting essentially of steel or titanium which is disposed in a through hole extending between outer and inner surfaces of a compressor casing of a gas turbine engine; and b) a first metal bushing consisting essentially of steel or titanium which is disposed in the through hole proximate the outer surface and which surrounds a first portion of the trunnion, wherein the first metal bushing and the first portion have wear-resistant coatings consisting essentially of a ceramic disposed thereon which are in mutual contact, apart from any intervening lubricant, when the trunnion is rotating with respect to the first metal bushing;

c) a second metal bushing consisting essentially of steel or titanium which is disposed in the through hole proximate the inner surface and which surrounds a second portion of the trunnion, wherein the second metal bushing and the second portion have wear-resistant coatings consisting essentially of a ceramic disposed thereon which are in mutual contact, apart from any intervening lubricant, when the trunnion is rotating with respect to the second metal bushing; and d) a gas seal which is disposed in the through hole and which surrounds a third portion of the trunnion, wherein the third portion is disposed between the first and second portions, and wherein the gas seal is more flexible than either of the first and second metal bushings.

16. The variable stator vane assembly of claim 15, wherein at least one of the wear-resistant coatings of the first metal bushing and the first portion is lubricated to reduce friction from rotation of the trunnion with respect to the first metal bushing, and wherein at least one of the wear-resistant coatings of the second metal bushing and the second portion is lubricated to reduce friction from rotation of the trunnion with respect to the second metal bushing.

17. The variable stator vane assembly of claim 16, wherein the wear-resistant coatings of the first and second metal bushings and the first and second portions consist essentially of a ceramic.

18. The variable stator vane assembly of claim 17, also including a vane button which is attached to the trunnion and supports a vane airfoil, which is disposed proximate the second portion, and which extends substantially perpendicularly away from the trunnion, wherein the second metal bushing and the vane button have wear-resistant layers which are in mutual contact, apart from any intervening lubricant, when the trunnion is rotating with respect to the second metal bushing.

19. The variable stator vane assembly of claim 18, wherein the first and second metal bushings each include an outer circumferential surface which is coated with a wear-resistant material which contacts the compressor casing.

20. The variable stator vane assembly of claim 19, wherein the first and second metal bushings are press fitted into the through hole.

* * * * *